United States Patent [19]

Feneberg

[11] 4,052,916

[45] Oct. 11, 1977

[54] PROCESS FOR MAKING A DIE PUNCH

[75] Inventor: Paul Feneberg, Planegg, Germany

[73] Assignee: AGFA-Gevaert AG, Leverkusen, Germany

[21] Appl. No.: 663,815

[22] Filed: Mar. 4, 1976

[30] Foreign Application Priority Data

Mar. 27, 1975 Germany ..... 2513773

[51] Int. Cl.[2] ..... B21K 5/20

[52] U.S. Cl. ..... 76/107 R

[58] Field of Search ..... 76/107 R

[56] References Cited

U.S. PATENT DOCUMENTS

| | | | |
|---|---|---|---|
| 3,343,430 | 9/1967 | Haas et al. | 76/107 R X |
| 3,526,949 | 9/1970 | Genovese | 76/107 R X |
| 3,727,489 | 4/1973 | Inoue | 76/107 R |

*Primary Examiner*—James L. Jones, Jr.
*Assistant Examiner*—James G. Smith
*Attorney, Agent, or Firm*—Michael J. Striker

[57] ABSTRACT

A concave die punch of the type required in the formation of silicone elastomer contact lenses in which the curvature of the marginal zone is greater than the curvature of the central zone is made by making a convex die negative from glass or a vitreous ceramic; providing the negative with a thin metal coating, and then forcing a concave die positive made of a heat hardenable plastic in an enclosed space against the metal coated surface of the die negative while heating the said resin to harden it, thereby causing the metal coating to adhere to the positive and thus transferring the metal coating to the die positive whereby a reproduction of the surface of the die negative on the die positive is obtained.

6 Claims, 6 Drawing Figures

PROCESS FOR MAKING A DIE PUNCH

BACKGROUND OF THE INVENTION

The customary contact lenses are hard at least in one stage of the manufacturing process. The rim and surface can therefore be machined for instance by turning or grinding.

Usually, the hard contact lenses made of polymethylmethacrylate or other plastics are usually machined and subjected to chip removal. After making the face and reverse side the rim is given the desired contours by turning or with a sharp blade followed by polishing. The lens then receives the final surfaces in a punch molding operation. The edge is however still thick and sharp edged and therefore must likewise be machined upon removal of the chips as decribed above.

In case of strong minus lenses a heavy edge occurs in the lens. These lenses must therefore receive a so-called lenticular shape, that is, the optically effective area of the lens must be kept as small as possible and as much matertial as feasible must be removed from the outer surface starting from the edge in order to obtain a physiologically acceptable edge thickness.

This type of processing is, as explained, possible only with hard materials. If the material is not hard at some stage of the manufacturing process, these metals can no longer be used. Such material is for instance silicone elastomer which, for various reasons, is a preferred material for making contact lenses.

The silicone elastomer material is soft alreadyin its initial stage. It is then subjected to a vulcanization in order to obtain a three-dimensional cross-linking. After the vulcanization which is effected by means of pressure and heat, the finished product, in this case the cool contact lens is removed from the mold with its front and reverse side already in final shape. The finished product however is still more or less soft in view of the characteristics of the silicone elastomer and cannot be further processed.

In order to make a contact lens from this material where the lens is intended to have a higher degree of negative power of refraction a die puch is therefore necessary which already embodies the outer contours for making the lenticular shape. Such die punch must have a lesser degree of curvature in its central zone than in the marginal zones.

To make this kind of die puch by the established methods of precision mechanics and optics is however impossible. By these methods normally only spherical surfaces can be formed. The tools used in the course of these methods because of the divergent curvature required in the punch will impinge either against the flat or the steeper zone. For this reason the surfaces cannot be formed by coarse of fine grinding.

According to an earlier invention of the present inventor the die punch is made by first forming a convex negative and then copying the concave die punch from such negative by means of a copy method. For the copying, various methods are available such as for instance galvano-plastic reproduction. All of these methods however require a subsequent machining of the die positive in order to obtain an optically perfect surface. these processes are therefore of value for the industrial production only if many contact lenses are obtained by punching from one positive. For making a single contact lens or a few infrequently required lenses, the earlier invention would be too costly.

It is therefore an object of the present invention to provide a process for obtaining die positives by simple reproduction in cases where the die positives cannot be produced by a direct method and to provide for such method of reproduction from easily formed negatives.

SUMMARY OF THE INVENTION

This object is solved by a process comprising a. making a convex die negative of desired differential curvature from glass or a vitreous ceramic;

b. providing the negative with a thin metal coating; and c. then forcing a concave die positive made of a heat hardenable resin in an enclosed space against the metal coated surface of the die negative while heating the said resin to harden it, thereby causing the metal coating to adhere to the positive and thus transferring the metal coating to the positive whereby the surface of the die negative is reproduced on the die positive.

DISCUSSION OF THE INVENTION AND PREFERRED EMBODIMENTS

In the preferred embodiment of the invention, the negative of the punch is made of glass or a vitreous ceramic. The punch surface is then formed with a thin metal coating and the positive which preferably is made of an epoxy resin is then forced into close contact with the negative. The pressure contact causes the metal coat to become detached from the negative and the adhere to the surface of the positive. The metal layer on the positive then results in an optical surface on the punch since chemical reaction of the silicone elastomer with the epoxy resin from which the positive is made are avoided by the interposition of the metal surface.

The metal surface may be a silver layer applied by chemical reduction from a silver nitrate. Still better results are obtained by vacuum evaporation of a silver layer or gold layer on the negative.

Figure 1:
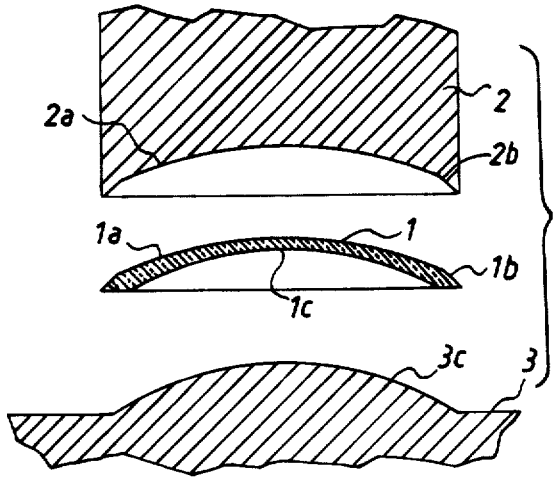
FIG. 1 illustrates schematically a die apparatus for making contact lenses by a process of reproduction from the negative to the positive of the die punch, but without using the special process of the present invention.

With specific reference to FIG. 1 it will be noted that 1 indicates a contact lens which has the shape of a negative meniscus. In order to avoid a sharp edged outer surface of the rim the rim is formed in the way of a zone of a sphere having an increaed curvature as indicated at 1*b*. The surface 1*a* and, if desired, also 1*c*, accordingly has a considerably larger curvature than the edge portion 1*b*.

2 indicates a punch die of which the surfaces 2*a* and 2*b* correspond exactly to the surfaces 1*a* and 1*b* of the contact lens. The second part of the punch has a tape portion 3*c* which corresponds to the surface 1*c* of the lens. The surfaces 1*a* and 1*b* of the lens, and accordingly also the surfaces 2*a* and 3*c* of the die must have dimensions exactly as required by optics of the case The methods of precision optics for grinding and polishing are well known and further decribed in Schade, Arbeitsverfahren der Feinoptik, Desseldorf 1955.

With the methods for grinding lenses as they are known and described there, the surface 3*c* could be readily formed in an exact spherical shape. However, with the surface 2*a* this is not possible since the edge 2*b* would be in the way of the cap-shaped grinding and polishing wobble tool.

Figure 2:
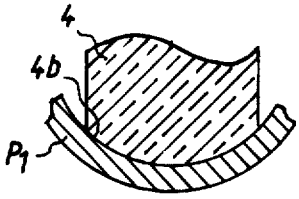
FIG. 2 schematically shows the first stage of the forming of the punch negative by the process of the present invention.
Figure 3:
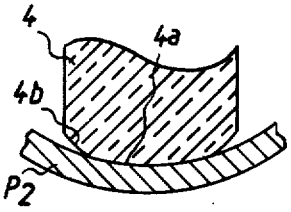
FIG. 3 schematically shows the second stage of forming the punch negative.

It is for this reason that the reproduction of the punch positive from an easier made punch negative has been undertaken. In FIG. 2 there is shown the processing of a negative 4 by means of a grinding tool in bowl-shape P1 of a relatively small radius. FIG. 3 shows the same operation with a grinding tool of a larger radius. As appears from FIG. 3 the processing is first effected by making the marginal portion 4*b* and then the apex portion 4*a*.

According to the invention the punch negative 4 is made of glass or a vitreous ceramic in which case the well known optical methods permit to obtain an optically perfect surface.

Figure 4:
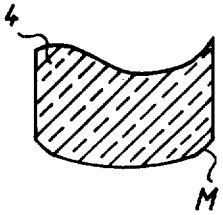
FIG. 4 schematically shows the application of a metal coating to the punch negaitve.

FIG. 4 then shows the finished stam negative 4. This negative is then provided with a thin metal coating M preferably a silver layer. The silver layer M can be obtained by chemical reduction of silver nitrate as it is generally practiced in making mirrors. It is however also possible to deposite the silver layer or also a gold layer by vacuum evaporation.

Figure 5:
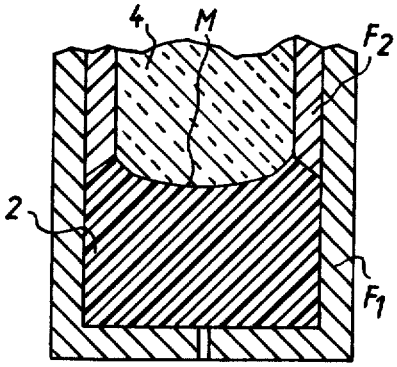
FIG. 5 schematically shows the reproduction of the negative onto the positive of the punch.

FIG. 5 now shows the reproduction of the die positive 2 from the die negative 4. For this purpose a mold is used consisting of a cylindrical vessel F1 and a gasket F2 both of which consist of metal. The resin, preferably an epoxy resin, from which the positive is formed, is then heated and hardened in conventional manner. This causes the silver layer M to become detached from the negative 4 and to adhere to the posivite 2. Since the concave side of the metal layer is optically perfect, there is now obtained an optically unobjectionable surface on the positive which thus is adapted for die forming of silicone elastomer lenses. Instead of an epoxy resin, it would also be possible to use other resins such as polyeser resins, silicone resins and thermoplastic materials, polycarbonates e.g.

Figure 6:
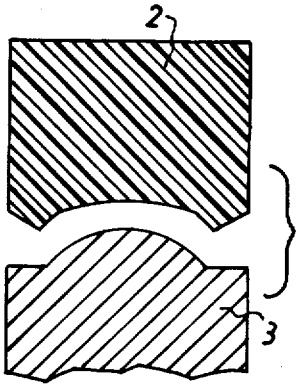
FIG. 6 shows schemactically a finished set of punches.

FIG. 6 shows a corresponding set of dies. The lower portion 3 could of course be made in the same manner as the other portion 2.

It has been found that the die punch of the invention can form aabout 20 perfect lenses. This is a sufficient number for the purpose of the invention.

Once the punch has been used up it can be restored in a simple manner by new depositing of metal on the negative 4 which is preserved and then reproducing a new positive as illustrated in FIG. 5.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for making a concave die or die punch of the type required in the formation of highly specific silicone elastomer contact lenses of negative power of refraction in which the curvature of the marginal zone must be greater than the curvature of the central zone, the said process comprising a. making a convex die negative of desired differential curvature from gals or a vitreous ceramic;

b. providing the negative with a metal coating of a thinness to permit it fully to conform to the surface curvatures of the die negative;

c. placing a concave die positive consisting of a heat hardenable resin in uncured condition in an open top mold; and d. introducing the die negative into the mold and bringing the said metal coated surface of the die negative within the constrained spaced of the mold into close contact with the die positive while heating the said resin to harden it, thereby causing the metal coating to become detached from the die negative and to adhere to the die positive, thus transferring the metal coating to the die positive so that the surface of the die negative is reproduced on the die positive.

2. The process of claim 1 wherein the diepositive is made of an epoxy resin.

3. The process of claim 1 wherein a silver layer is formed on the die negative by chemical reduction of a silver nitrate so as to form said metal coating on the die negative.

4. The process of claim 1 wherein a metal layer is deposited on the die negative by vacuum evaporation so as to form said metal coating on the die negative.

5. The process of claim 4 wherein the metal is silver.

6. The process of claim 4 wherein the metal is gold.

* * * * *